US006883200B1

(12) United States Patent
Euler

(10) Patent No.: US 6,883,200 B1
(45) Date of Patent: Apr. 26, 2005

(54) TOOTH BRUSH

(76) Inventor: Heinrich Georg Euler, Distelweg 7, D-51146 Köln (DE)

( * ) Notice: Subject to any disclaimer, the term of this patent is extended or adjusted under 35 U.S.C. 154(b) by 0 days.

(21) Appl. No.: 09/564,106

(22) Filed: May 3, 2000

(30) Foreign Application Priority Data

Oct. 1, 1999 (DE) ..... 299 17 295 U

(51) Int. Cl.[7] ..... A46B 9/04
(52) U.S. Cl. ..... 15/167.1; 15/172
(58) Field of Search ..... 15/143.1, 144.1, 15/145, 167.1, 172, 176.1; D4/104

(56) References Cited

U.S. PATENT DOCUMENTS

| | | | | | |
|---|---|---|---|---|---|
| 3,994,038 | A | * | 11/1976 | Moulet | 15/167.1 |
| 4,575,894 | A | * | 3/1986 | Stevens et al. | 15/172 |
| 5,054,154 | A | * | 10/1991 | Schiffer et al. | 15/167.1 |
| 5,673,452 | A | * | 10/1997 | Chang et al. | 15/167.1 |
| 5,707,166 | A | * | 1/1998 | Jeannet et al. | 15/167.1 X |
| 5,774,923 | A | * | 7/1998 | Halm | 15/167.1 |
| 6,003,189 | A | * | 12/1999 | Falleiros | 15/167.1 |

FOREIGN PATENT DOCUMENTS

| | | | | |
|---|---|---|---|---|
| CH | 155730 | * | 9/1932 | 15/167.1 |
| DE | 8609802 | | 10/1990 | |
| EP | 0462509 | | 12/1991 | |
| NL | 6712131 | * | 3/1968 | 15/144.1 |
| WO | 94/09675 | * | 5/1994 | 15/167.1 |
| WO | 9916332 | | 4/1999 | |
| WO | 99-39610 | | 8/1999 | |

* cited by examiner

*Primary Examiner*—Mark Spisich
(74) *Attorney, Agent, or Firm*—Friedrich Kueffner

(57) ABSTRACT

The tooth brush with a head part (12) carrying bristles (10) and with a handle part (14), the head part (12) being connected with the handle part (14) by means of a resilient device in such a way that the head part (12) is pivotable against the handle part (14), is configured in such a way that the resilient device (16) is configured as a damping element, the head part (12) being additionally resiliently connected with the handle part (14) in direction of a longitudinal axis (24) of the tooth brush.

5 Claims, 9 Drawing Sheets

TOOTH BRUSH

BACKGROUND OF THE INVENTION

1. Field of the Invention

This invention relates to a tooth brush with a head part carrying bristles and with a handle part, the head part being connected with the handle part by means of a resilient device in such a way that the head part is pivotable against the handle part.

2. Description of the Related Art

Tooth brushes for which the head can be resilient against the handle in a direction perpendicularly to a longitudinal axis of the tooth brush are already known. However, such tooth brush spring systems have the disadvantage that they cushion only into one direction namely against a pressure on the bristle side onto the head. A further disadvantage of traditional spring-loaded tooth brushes is that the equipment of such a tooth brush with an interchangeable head is extremely complicated, since the locking of the interchangeable head in a neck area of the tooth brush constitutes a partial stiffening of the tooth brush which undesirably counteracts the resiliency of the head against the handle. Thus, it has already been proposed to configure the interchangeable head in form of an interchangeable bristle zone. However, it comes here to a hygienically dangerous important dirt accumulation in the bristle zone at the corresponding butt points or surfaces. Add to this that in interchangeable head systems the cushioning of tooth brushes by head separations in the neck area often results in a release of the interchangeable head connection due to the arising lever forces.

The aim of this invention is to make available an improved tooth brush of the above mentioned type which eliminates the above mentioned disadvantages.

SUMMARY OF THE INVENTION

To this end, the resilient device is configured as an one-piece or a multipiece damping element made of an homogeneous material or of several different materials, the head part being additionally resiliently connected with the handle part in direction of a longitudinal axis of the tooth brush.

The further development of the invention consists in that the resilient device is configured as a damping element, the head part being additionally resiliently connected with the handle part in direction of a longitudinal axis of the tooth brush and being made of a spring member which has any geometrical form with at least one opening and which is configured as a massive part.

This has the advantage that a pressure from above onto the head part in direction of the bristles arising because of the teeth brushing as well as a front pressure onto the head part in direction of the longitudinal axis of the tooth brush cause a cushioning of the head part with respect to the handle part so that injuries to the oral cavity are avoided still more efficiently.

Preferable further developments of the tooth brush are indicated in the subclaims.

The massive spring member or the spring member provided with at least one opening runs parallel or perpendicularly to the longitudinal axis of the tooth brush or in any other direction.

In a preferred embodiment, the resilient device comprises a juncture point between the head part and the handle part which shows a predetermined distance to the longitudinal axis of the tooth brush and is configured, for example, as an articulation or as a flexible junction.

Herewith, we obtain a particularly good spring characteristic when the juncture comprises a first elevation configured in one piece with the head part and a second elevation configured in one piece with the handle part which are hinged with each other.

In an appropriate way, the first and/other the second elevation is made of a flexible material and is configured for example arcuated, especially in form of a quarter circle.

In a preferred alternative embodiment, the juncture shows an arcuated especially a semicircular elevation made of a flexible material which is connected in one piece with the head part and the handle part.

In a preferred embodiment of the invention, the resilient device comprises a spring member made of a flexible material which is placed between the head part and the handle part.

Here, the spring member is configured in one piece with the handle part and/or the head part or is alternatively detachably connected with the handle part and the head part.

Appropriately, the spring member is configured ring-shaped, elliptical, disk-shaped or cylindrical.

The spring member between the handle part and the head part of the tooth brush preferably consists of a plate-shaped moulded body with two partial rings connected with each other which are placed horizontally or vertically to the longitudinal axis of the tooth brush. The spring member can also consist of a plate-shaped, square, circular, an oval moulded body or of a moulded body showing another geometrical two-dimensional or three-dimensional form with two openings placed superimposed or side by side, the plate-shaped moulded body being placed horizontally or vertically to the longitudinal axis of the tooth brush. The number of openings in the plate-shaped moulded body can be chosen at will and respectively depends on the springiness to be achieved.

According to another embodiment, the spring member consists of a plate-shaped, square, circular, an oval moulded body or of a moulded body showing another geometrical two-dimensional or three-dimensional form with three openings, the plate-shaped moulded body being placed horizontally or vertically to the longitudinal axis of the tooth brush.

The spring member can also consist of a plate-shaped moulded body moulded on the handle part of the tooth brush with an opening with an approximately arcuated triangular configuration on which the head part is moulded in the biggest arc area of the opening, the moulded body being also placed in this embodiment horizontally or vertically to the longitudinal axis of the tooth brush.

A further embodiment consists in that the spring member consists of a plate-shaped moulded body with a drop-shaped oppening which is placed horizontally or vertically to the longitudinal axis of the tooth brush, whereby the conformation of the moulded body can have any two-dimensional or three-dimensional configuration shaping.

BRIEF DESCRIPTION OF THE DRAWINGS

The invention will be explained in detail below with reference to the attached drawings.

DETAILED DESCRIPTION OF THE PREFERRED EMBODIMENT

Figure 1:
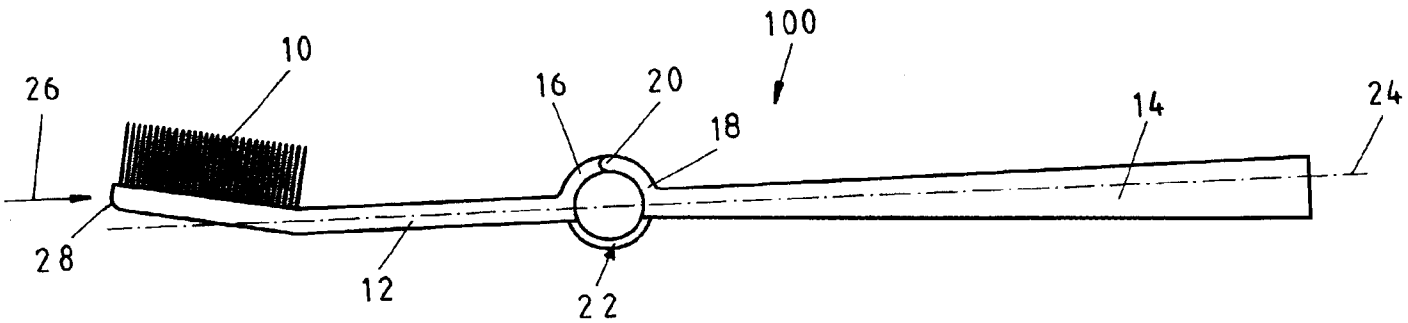
FIG. 1 is a side view of a tooth brush with a resilient device when mounted.
Figure 2:
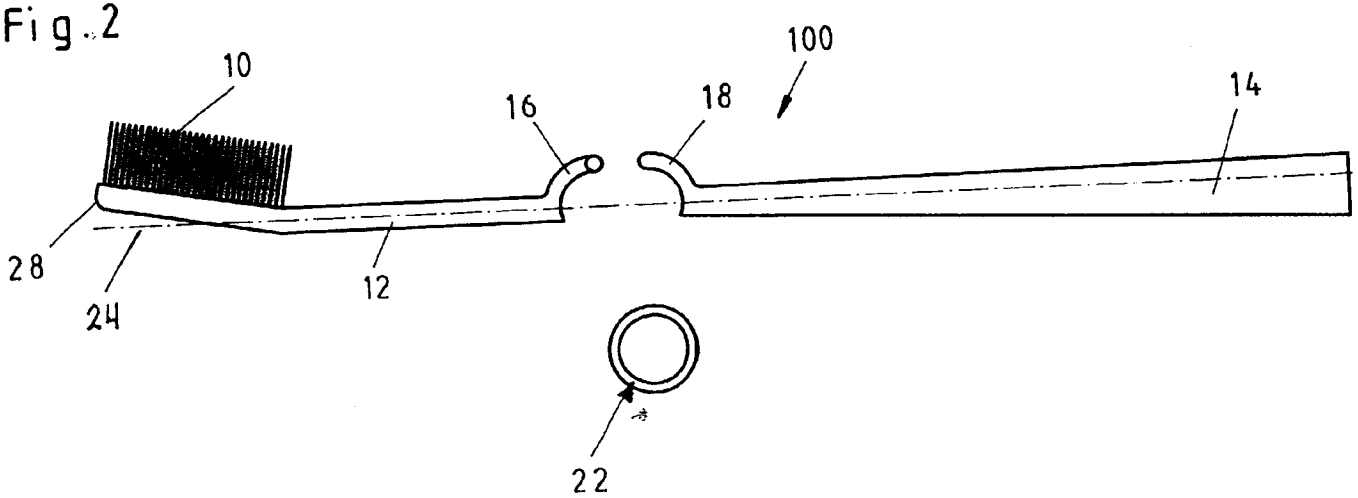
FIG. 2 is a side view of the tooth brush according to FIG. 1 when dismantled.

FIGS. 1 and 2 show examples of different preferred embodiments of a tooth brush, the same parts in the figures and in the following description being designated respectively with the same reference numerals.

The embodiment of a tooth brush 100 represented in FIGS. 1 and 2 comprises a head part 12 carrying bristles 10 and a handle part 14. A first elevation 16 on the head part 12 and a second elevation 18 on the handle part 14 are configured in one piece, whereby both elevations act in connection with their articulation-type configuration as a damping element. Both arm-type elevations 16, 18 are configured as quarters of a circle and are provided at their respectively open ends which are turned to each other with articulating means so that both elevations 16 and 18 can be detachably hinged together. The handle part 14 and the head part 12 are pivotable against each other about the resulting hinge-type joint 20.

The handle part 14 and the head part 12 are detachably connected with each other over the joint 20 so that the head part 12 is replaceable after the bristles 10 having been correspondingly worn out. The head part 12 can then be replaced by a new head or an alternative health care part as illustrated in FIG. 2.

Moreover, a ring-shaped spring member 22 is provided in the area of the hinge 20, this spring member causing a correspondingly resilient connection between the head part 12 and the handle part 14, whereby the spring member can show different configurations, as will still be explained below. Here, a resilient relative movement between the handle part 14 and the head part 12 against each other does not take place only by pressure onto the bristles 10 but also along a longitudinal axis 24 (FIG. 1) of the tooth brush 100, the spring member 22 being correspondingly compressed in case of a front pressure onto the head part 12, for example in direction of the arrow 26 (FIG. 1).

Thus, as far as an user clinks in the mouth with the front side 28 of the head part 12 of the tooth brush 100 when brushing his teeth, the head part 12 springs elastically against the handle part 14 in direction of the longitudinal axis 24 so that an injury in the mouth area due to the clinking with the front area 28 is efficiently avoided. This elastic springiness in direction of the longitudinal axis 24 is still additionally supported by the fact that the hinge 20 is spaced from the longitudinal axis 24 by a predetermined length. Furthermore, the elevations 16 and 18 are appropriately made of a flexible or elastic material.

The spring member 22 is placed detachable between the head part 12 and the handle part 14 so that the spring member 22 can be replaced, depending on the user's wishes, if necessary, by a harder or by a softer spring member 22.

Figure 3:
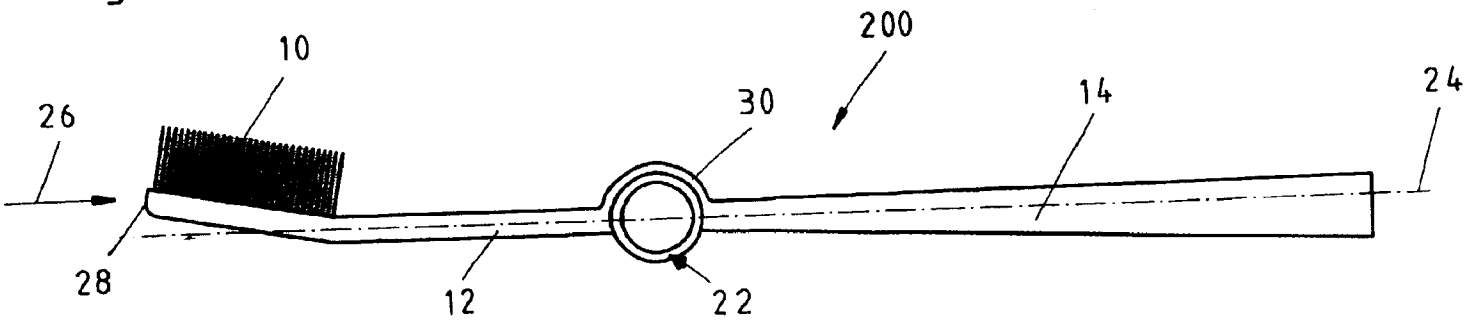
FIG. 3 is a side view of a tooth brush with a further embodiment of the resilient device when mounted.
Figure 4:
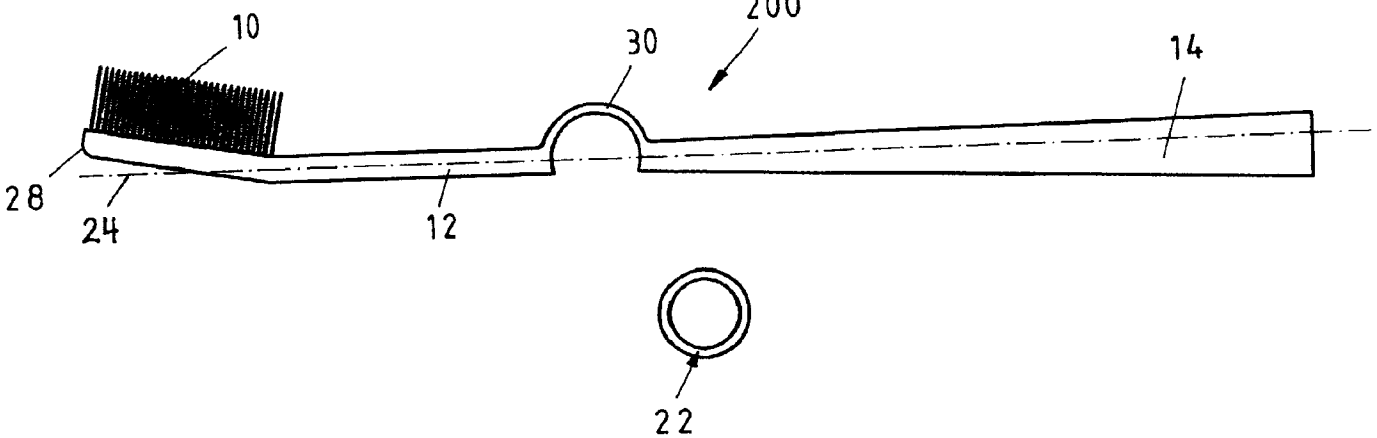
FIG. 4 is a side view of the tooth brush according to FIG. 3 when dismantled.

FIGS. 3 and 4 show a further embodiment of the tooth brush 200, whereby here no separation of the handle part 14 and of the head part 12 is provided for. Instead of this, the head part 12 and the handle part 14 are connected with each other in one piece with an arcuated elevation 30. This elevation is preferably made of a flexible or of an elastic material. The damping element 22 is also here preferably detachably inserted in the tooth brush 200 between the head part 12 and the handle part 14 and thus allows, by a corresponding choice of the material, a predetermined spring characteristic which can also be changed by a simple replacement of the spring member 22. The bending-in of the head part 12 with respect to the handle part 14 is carried out by a warping of the elevation 30 which compresses the spring member 22. As can directly be seen in FIGS. 3 and 4, due to the configuration of the tooth brush 200 according to the invention, there results a resilient movement of the head part 12 against the handle part 14 not only by pressure onto the bristles 10 but also by pressure onto the front side 28 of the head part 12 of the tooth brush 200, for example in direction of the arrow 26.

Here, a bending-in of the head part 12 also in direction of the longitudinal axis 24 is achieved which correspondingly reduces the risk of an injury around the mouth area of an user when clinking with the front side 28 of the tooth brush 200.

Figure 5:
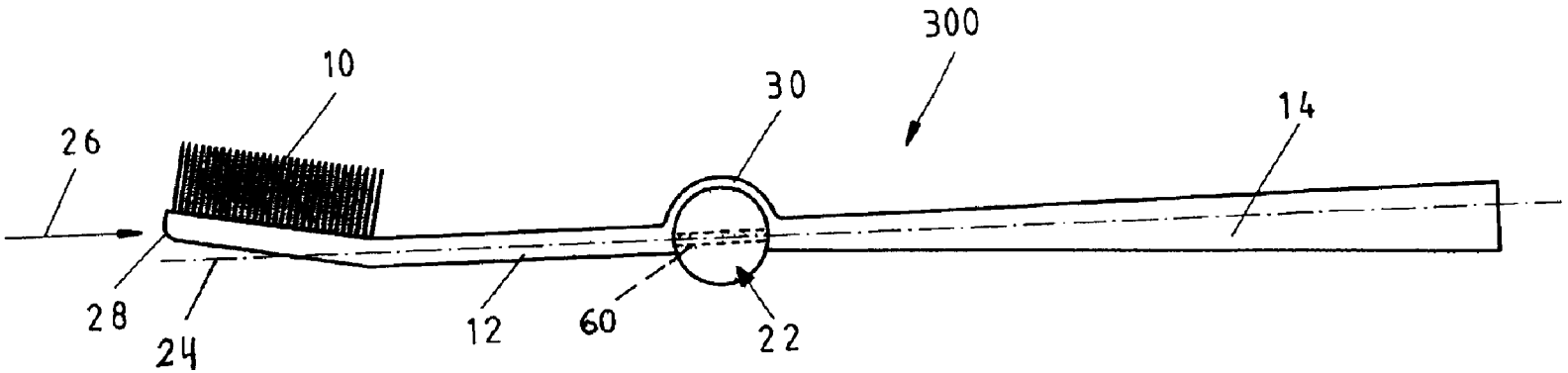
FIG. 5 is a side view of a tooth brush with a full surface spring member.

The embodiment of the tooth brush 300 represented in FIG. 5 differs from the embodiment 200 described above with reference to FIGS. 3 and 4 in that, instead of a ring-shaped spring member, a disk-shaped spring member 22 is used, whereby the spring member 22 can also be configured as a resilient spherical body; other geometrical configurations are also possible. For a spherical configuration of the spring member, it is advantageous when, for example, the head part 12 and the handle part 14 of the tooth brush are directly connected with the spherical body without the elasticity getting lost thereby. The opposite ends of the head part 12 and of the handle part 14 can be configured for receiving the spherical body as a shell, for example in form of a spherical calotte. The connection and fixing of both parts 12 and 14 can then take place by means of a connecting wire, a spring steel bar or of a plastic rod or the like 60 (FIG. 5) so that both parts 12 and 14 are held together without the flexibility of the spring member getting lost.

Figure 6:
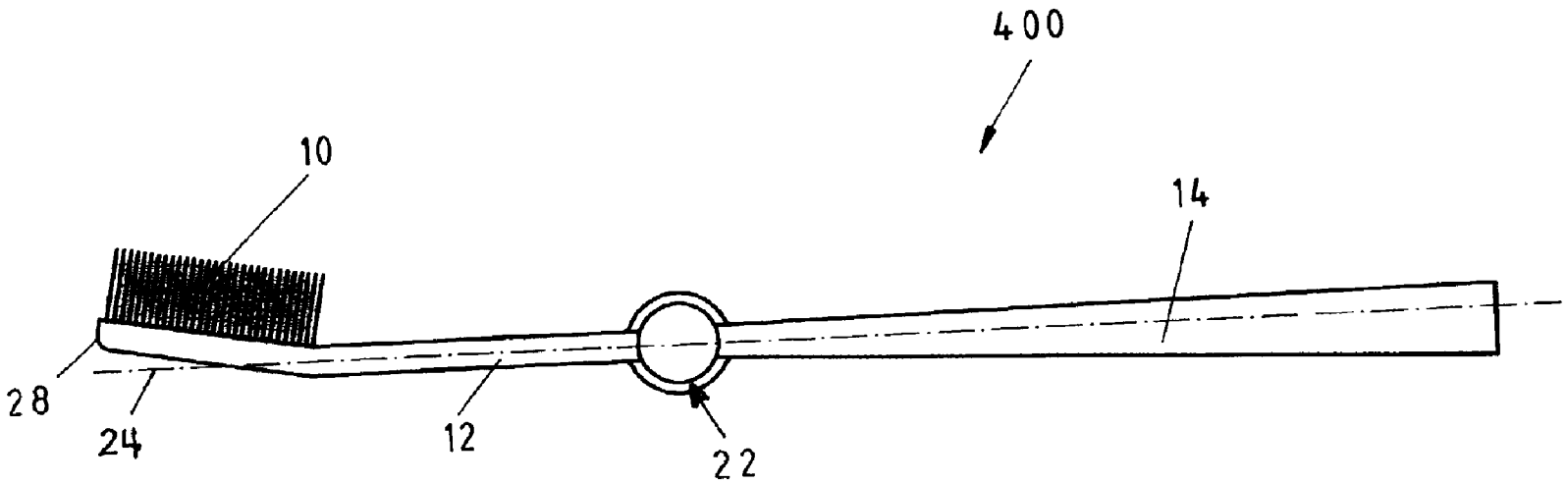
FIG. 6 is a side view of a tooth brush with a ring-shaped spring member.

For the embodiment of the tooth brush 400 represented in FIG. 6, no direct connection is provided for between the handle part 13 and the head part 12. The handle part 14 and the head part 12 are connected with each other only by the spring member 22. Hereby, the spring member 22 is detachably connected with the head part 12 as well as with the handle part 14.

Figure 7:
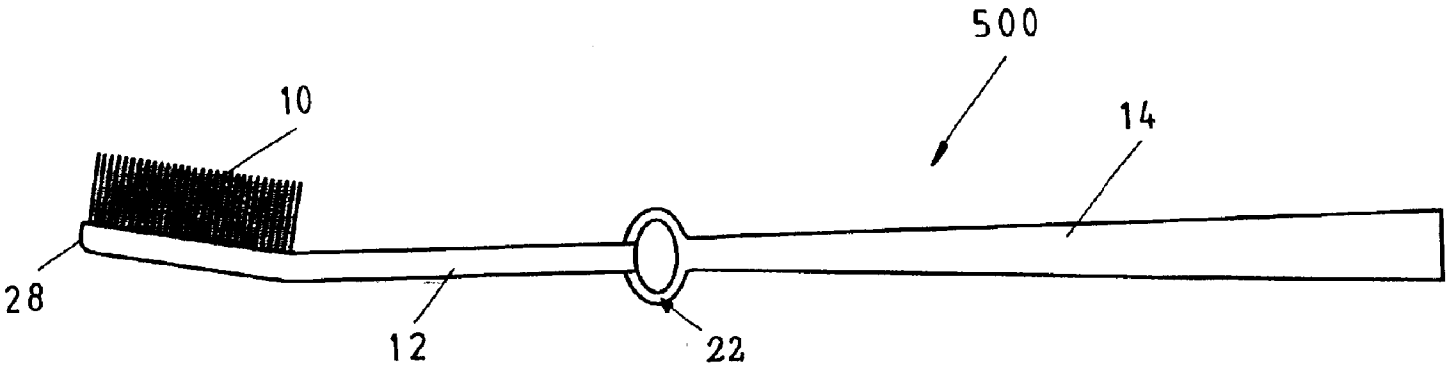
FIG. 7 is a side view of a tooth brush with an oval spring member.
Figure 8:
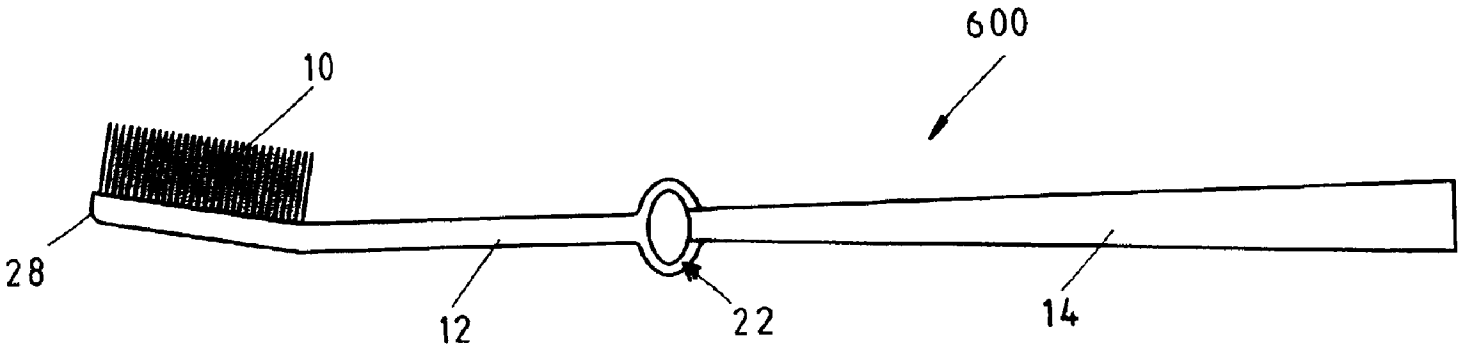
FIG. 8 is a side view of a further embodiment of a tooth brush with an oval spring member.
Figure 9:
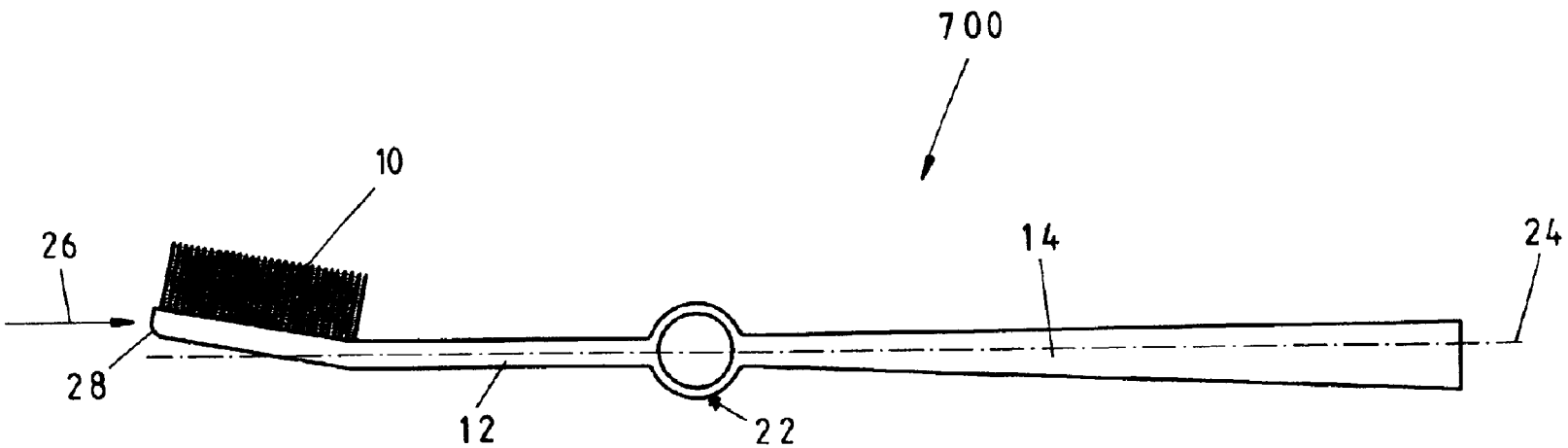
FIG. 9 is a side view of a further embodiment of a tooth brush with an oval spring member.

In alternative embodiments, the spring member 22 is fest connected with the handle part 14 and detachably with the head part 12 (FIG. 7), detachably with the handle part 14 and fest with the head part 12 (FIG. 8) or fest with the head part 12 as well as with the handle part 14 (FIG. 9).

The handle part 14 and/or the head part 12 of the tooth brush 100 to 700 are produced, for example, by one-part or two-part component fabrication. The spring member 22 is preferably made of a material specially selected for the purpose intended for. The spring member 22 is, for example, produced in a two-component method from one soft component. Alternatively, the spring member 22 is also produced from the same material as the handle part 14 and the head part 12, as far as these are made of an appropriate resilient material.

For the embodiments for which the spring member 22 is configured individually and can be placed form-fitting detachable between the handle part 14 and the head part 12 (FIG. 1 to 5), there results the particular advantage consisting in that the spring member 22 is interchangeable and can be selected individually with respect to the property of its spring characteristic. A ring-type form of the spring member 22 is particularly advantageous. Thus, it is possible to trigger the spring effect practically on each place of the ring 22 and in any direction without the spring properties being changed. Different spring effects can be achieved depending on material hardness, ring thickness and cross-section type. This effect can also be achieved by multiple component production. A predetermined colour of the ring 22 can give information on its properties or only mark or individualize the respective tooth brush 100 to 700. Both parts of the tooth brush—handle part 14 and head part 12—are either hung up on the ring 22 or, for example, fit together above the ring. Due to pressure onto the bristles 10, the head part 12 tends to clap in the art of scissors against the handle part 14 in the figure downwards which is however cushioned by the spring member 22.

As far as the spring member 22 is configured fest or in one piece on the head part 12, the replacement of the head part 12 always takes place completely with the spring member 22. Since the spring member 22 also wears in the course of time, this type of replacement is particularly advantageous.

A further advantage of the head separation according to the invention in the area of the resilient device consists in that the point of separation remains outside the oral cavity during teeth brushing and is thus protected against coarse soiling. Furthermore, this point of separation is easy to clean due to the optimal thorough rinsing ability and also copes with strong permanent loads.

For the embodiment according to FIG. 9, due to the complete one-piece configuration of the tooth brush 700 with or without integrated spring member, there results a particularly efficient cushioning of pressure and shocks onto the head part 12 in direction of the longitudinal axis 24, for example in direction of the arrow 26.

Apart from the ring-shaped configuration of the spring member 22, other geometry types are also possible which are adapted to the eventual specific requirements to the function of the tooth brush 100 to 700. The spring members 22 can then be configured two-dimensional or three-dimensional. If the spring member is configured plate-shaped, it can be placed lying between the handle part 14 and the head part 12 horizontally or vertically to the longitudinal axis 24 of the tooth brush.

Moreover, the spring member 22 is for example additionally equipped with a "core" of full material to influence the spring characteristic. Alternatively, the spring member 22 is configured filled with one or two components.

The spring member 22 in a soft embodiment can totally be replaced without support by a harder plastic. This means, it is known that the spring members or damping elements in tooth brushes consist, for example, of tapers in the plastic material, when they are made of only one hard plastic material. But if the spring members or the damping elements are made of an elastomer, thus of a rather gummy plastic material, they will always be stiffened by means of the hard second component to a proportion necessary for the function, since the elastomer alone would be too soft. However, the ring-shaped spring member 22 can be made of the monomaterial appropriate for the function. This can be hard elastomer or another plastic material.

Figure 10:
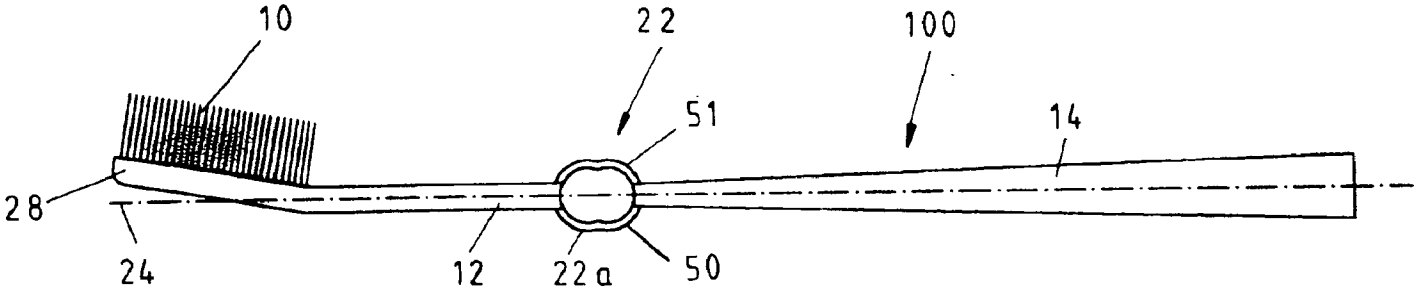
FIG. 10 is a side view of a tooth brush with a double ring-type configured spring member.

For the tooth brush 100 according to FIG. 10, a spring member 22 is placed between the head part 12 and the handle part 14, this spring member consisting in a plate-shaped moulded body 22*a* made of two partial rings 50, 51 connected with each other so that both ring openings merge. This plate-shaped moulded body can be placed lying horizontally or vertically to the longitudinal axis 24 of the tooth brush.

Figure 11A:
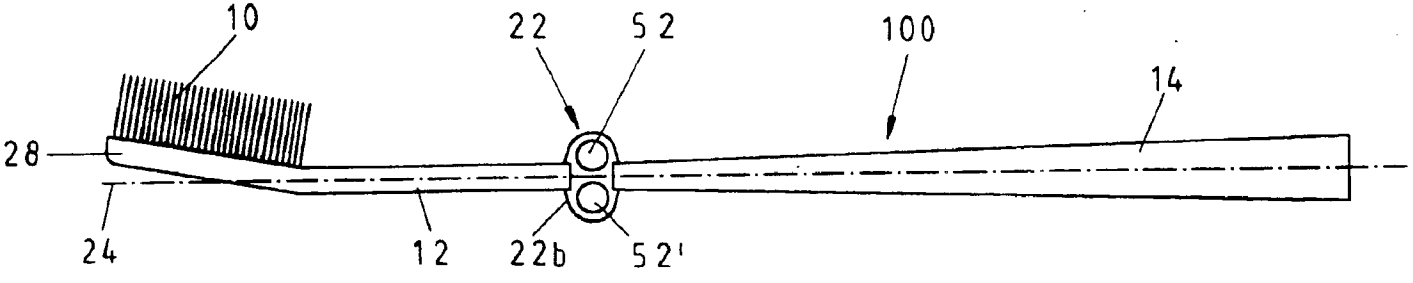
FIG. 11A is a side view of a tooth brush with a spring member with two superimposed openings.
Figure 11B:
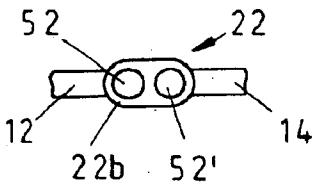
FIG. 11B is a side view of a tooth brush with a spring member with two openings placed side by side.

FIG. 11A shows an embodiment in which the spring member 22 consists of a plate-shaped moulded body 22*b* with two superimposed openings 52, 52', whereby the plate-shaped moulded body 22*b* can also lie horizontally or vertically to the longitudinal axis 24 of the tooth brush 100. This moulded body 22*b* with its both openings 52, 52' can also be placed according to FIG. 11*b* between the head part 12 and the handle part 14 of the tooth brush 100 in such a way that both openings 52, 52' lie side by side.

The number of the openings in the spring member 22 can be chosen arbitrarily. Moreover, the plate-shaped moulded body can show a square, a circular, an oval or another geometrical two-dimensional or three-dimensional form.

Figure 12:
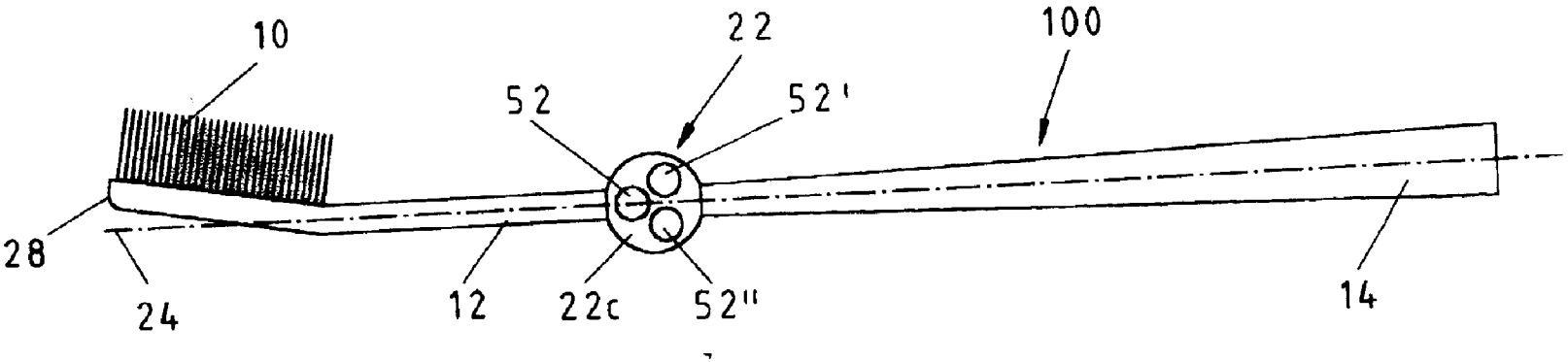
FIG. 12 is a side view of a tooth brush with a circular spring member with three openings.

For the tooth brush 100 according to FIG. 12, the spring member 22 can consist of a plate-shaped, a square, a circular, an oval moulded body 22*c* or of a moulded body 22*c* showing another geometrical two-dimensional or three-dimensional form which consists of three openings 52, 52', 52". If the moulded body 22*c* is configured plate-shaped, this moulded body can be placed between the head part 12 and the handle part 14 of the tooth brush 100 horizontally or vertically to the longitudinal axis 24 of the tooth brush.

Figure 13:
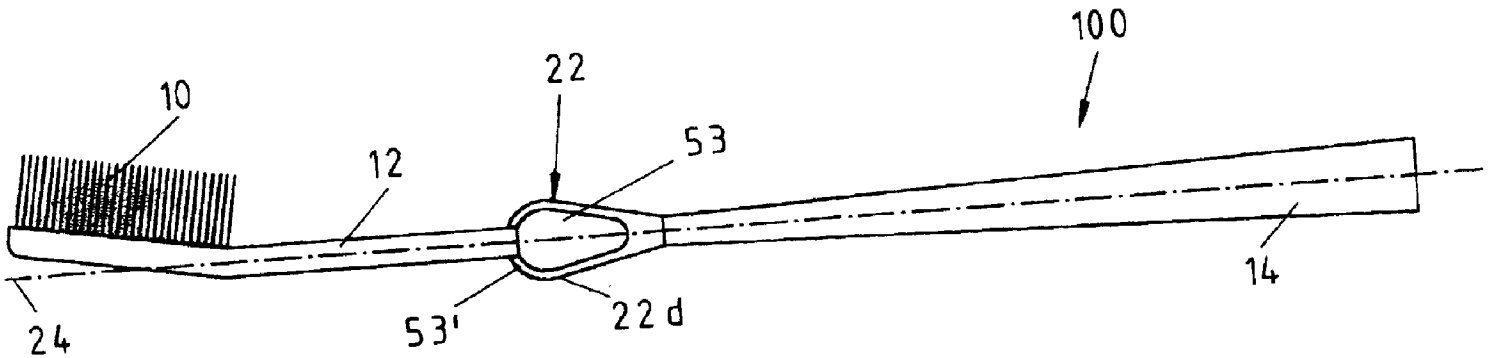
FIG. 13 is a side view of a tooth brush with a spring member with an arcuate triangular opening.

For the embodiment according to FIG. 13, the spring member 22 consists of a plate-shaped moulded body 22*d* moulded on the handle part 14 of the tooth brush 100 with one opening 53 with an approximately arcuated triangular or a drop-shaped configuration, moulded body on which the head part 12 is moulded in the bigger arc area 53' of the opening. For this embodiment, the plate-shaped moulded body 22*d* can also be placed horizontally or vertically to the longitudinal axis 24 of the tooth brush 100.

Figure 14:
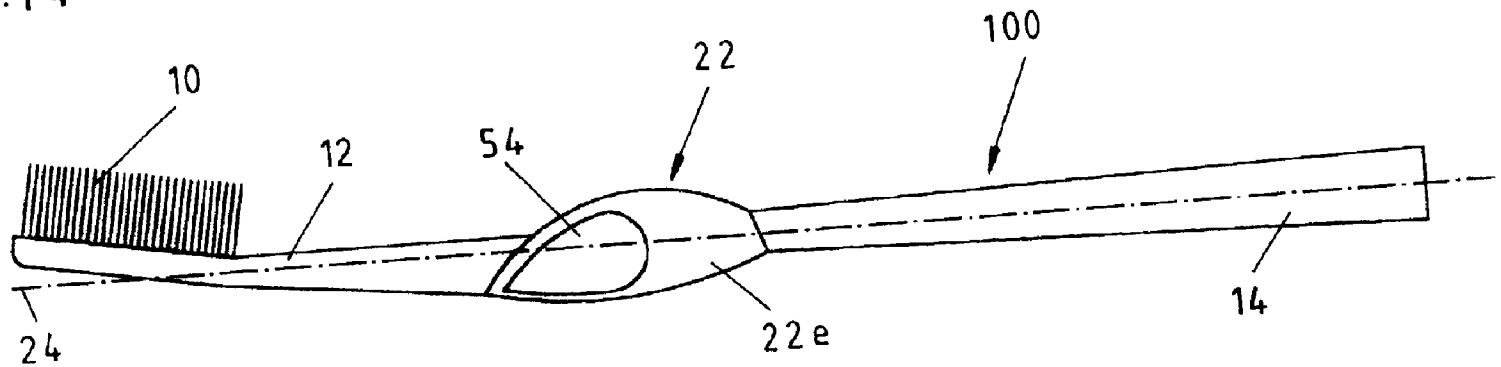
FIG. 14 is a side view of a tooth brush with a spring member with a drop-shaped opening.

A further configuration of the tooth brush 100 is represented in FIG. 14. Here, the spring member 22 consists of a plate-shaped moulded body 22*e* with a drop-shaped opening 54, the moulded body being also placed for this embodiment horizontally or vertically to the longitudinal axis 24 of the tooth brush 100.

The damping element 22 is preferably formed in one piece and consists of an homogeneous material, for example of an appropriate plastic. However, it is also possible to configure the damping element 22 in several pieces, the individual parts being then connected with each other form-fitted or by force. Then, this damping element made of several pieces preferably consists of various and/or different materials, for example of plastic materials with a different Shore hardness.

What is claimed is:

1. A tooth brush with a head part carrying bristles and a handle part, the tooth brush having a longitudinal central axis along which the handle part and head part extend, the head part and the handle part-being interconnected in such a manner that they are pivotable relative to each other and further wherein the head part is additionally resiliently connected to the handle part in a direction of the longitudinal central axis of the tooth brush, the head member having a first elevation configured in one piece with the head part and the handle part having a second elevation configured as one piece with the handle part, the first and second elevations forming a juncture point between the head part and the handle part which is laterally spaced from the central longitudinal axis so as to provide pivoting between the head and handle parts as well as some movement of the head part toward the handle part in the direction of the central longitudinal axis, the elevations each having a free end facing the free end of the other of the elevations, the free ends being detachably hinged together to form a hinged articulation so that the head part and the handle part are pivotable against each other, and a resilient spring member being arranged in a region of the articulation between the head part and the handle part.

2. The tooth brush according to claim 1, wherein at least one of the first and second elevations is of a flexible material.

3. The tooth brush according to claim 1, wherein at least one of the first and second elevations has an arcuated shape.

4. The tooth brush according to claim 3, wherein the arcuated shape is in the form of a quarter circle.

5. The tooth brush according to claim 1, wherein the spring member is detachably connected to the head part and the handle part.

* * * * *